United States Patent [19]

Steele

[11] Patent Number: 4,944,598

[45] Date of Patent: Jul. 31, 1990

[54] CONTINUOUS FLOW AIR BLENDER FOR DRY GRANULAR MATERIALS

[75] Inventor: James R. Steele, Stillwater, Minn.

[73] Assignee: Dynamic Air Inc., St. Paul, Minn.

[21] Appl. No.: 349,780

[22] Filed: May 10, 1989

[51] Int. Cl.[5] ..... B01F 13/02

[52] U.S. Cl. ..... 366/106; 366/101; 366/107

[58] Field of Search ..... 366/101, 3, 106, 192, 366/107, 267, 177, 341, 336; 222/195, 630, 1; 406/85, 137; 251/63

[56] References Cited

U.S. PATENT DOCUMENTS

| | | | |
|---|---|---|---|
| 3,097,828 | 7/1963 | Grun | 366/106 |
| 3,159,383 | 12/1964 | Van Munster | 366/107 |
| 3,386,182 | 6/1968 | Lippert | 366/107 |
| 3,647,188 | 3/1972 | Solt | 366/107 |
| 3,913,891 | 10/1975 | Steele | 366/267 |
| 4,325,495 | 4/1982 | Mokris | 222/195 |
| 4,326,810 | 4/1982 | Schofield et al. | 366/106 |
| 4,375,335 | 3/1983 | Klein-Albenhausen | 366/15 |
| 4,472,062 | 9/1984 | Balzau et al. | 406/85 |
| 4,534,653 | 8/1985 | Courtay | 222/195 |
| 4,595,296 | 6/1986 | Parks | 366/106 |
| 4,655,603 | 4/1987 | Palm | 366/107 |

*Primary Examiner*—Timothy F. Simone
*Attorney, Agent, or Firm*—Jacobson and Johnson

[57] ABSTRACT

Pressurized air is applied to dry granular materials as they enter the top of a vessel to mix the materials together and the mixed materials continuously flow out of the vessel through a bottom discharge opening.

5 Claims, 3 Drawing Sheets

35
13
20
26
25
15
14
16
33
24
27
23
32
22
31

37
11
10
19
36
36
12
36
13
35
14
20
20
16
15
16
22
22

CONTINUOUS FLOW AIR BLENDER FOR DRY GRANULAR MATERIALS

FIELD OF THE INVENTION

This invention is for use in pneumatically mixing or blending together in a hopper or bin a plurality of dry granular materials. More particularly the invention is directed toward pneumatically mixing or blending while the materials are being fed into and continuously flowing through the hopper.

DESCRIPTION OF THE PRIOR ART

Representative of the prior art is U.S. Pat. No. 3,913,891 dated Oct. 21, 1975 by Steele titled "Air Blender for Granular Material". As described in the '891 patent, granular materials which are to be mixed together are transported by air through a pipeline or conduit and are fed into the top of a suitable holding vessel or container or hopper. The vessel has a discharge opening at the bottom, usually at the center, which is closed while the materials are fed into the vessel in their proper ratios. After the materials have been inserted into the container, short bursts of pressurized air are periodically injected from the bottom of the container or hopper to create turbulence causing the materials to mix or blend together. The pressure and the number of cycles of the injected mixing air blasts depends to a degree upon the nature of the granular materials that are being mixed together. Generally, a small batch of materials is first tested for various pressure and cycle settings until the correct settings are determined and then the main batch of material is blended. After blending, the discharge opening at the bottom of the vessel is opened and the blended material is then discharged out of the vessel usually into another conduit or pipeline. As described in the '891 patent, the pressurized air for mixing is injected into the vessel or hopper from an air manifold located at or near the bottom of the hopper. The manifold has openings for the pressurized air contained within the manifold chamber to be injected upward into the materials contained in the vessel. Air operated pistons are periodically energized to open and close the openings in the manifold to produce pulses or bursts of pressurized air into the vessel for mixing the materials. In the past the openings in the '891 air manifold were generally angled outward with respect to the vertical center line of the vessel to direct the air upward and outward, i.e., towards the interior of the sidewall of the vessel.

SUMMARY OF THE INVENTION

The instant invention uses a vessel or hopper similar to the type shown in the '891 patent with the granular materials to be blended fed into the top of the vessel through a suitable conduit so that they fall toward the bottom. In the instant invention the pistons within the manifold are operated to apply the bursts or pulses of pressurized air through the manifold openings upward into the incoming materials while the materials are being fed into the hopper. In the preferred embodiment, the discharge opening at the bottom of the hopper remains open so that the materials continuously flow into the vessel and the mixed materials continuously flow out the discharge opening.

As a natural phenomenon, the granular materials generally have a tendency to try to flow in a direct straight-line fashion from the input at the top of the hopper, somewhat like a column, down through the discharge opening which would result in the materials not being adequately blended. A diverter, or deflector, preferably in the shape of a cone, is located over the discharge opening to prevent the materials from flowing or falling directly from the input out the discharge opening by deflecting the materials into the zones where the pressurized air pulses are injected so that they will be properly blended.

As a further feature of the invention, it has been found that more uniform and complete blending is achieved by angling the air manifold openings slightly inward, that is toward the vertical center line of the hopper instead of outward as in the '891 patent.

DESCRIPTION OF THE PREFERRED EMBODIMENTS

Figure 1:
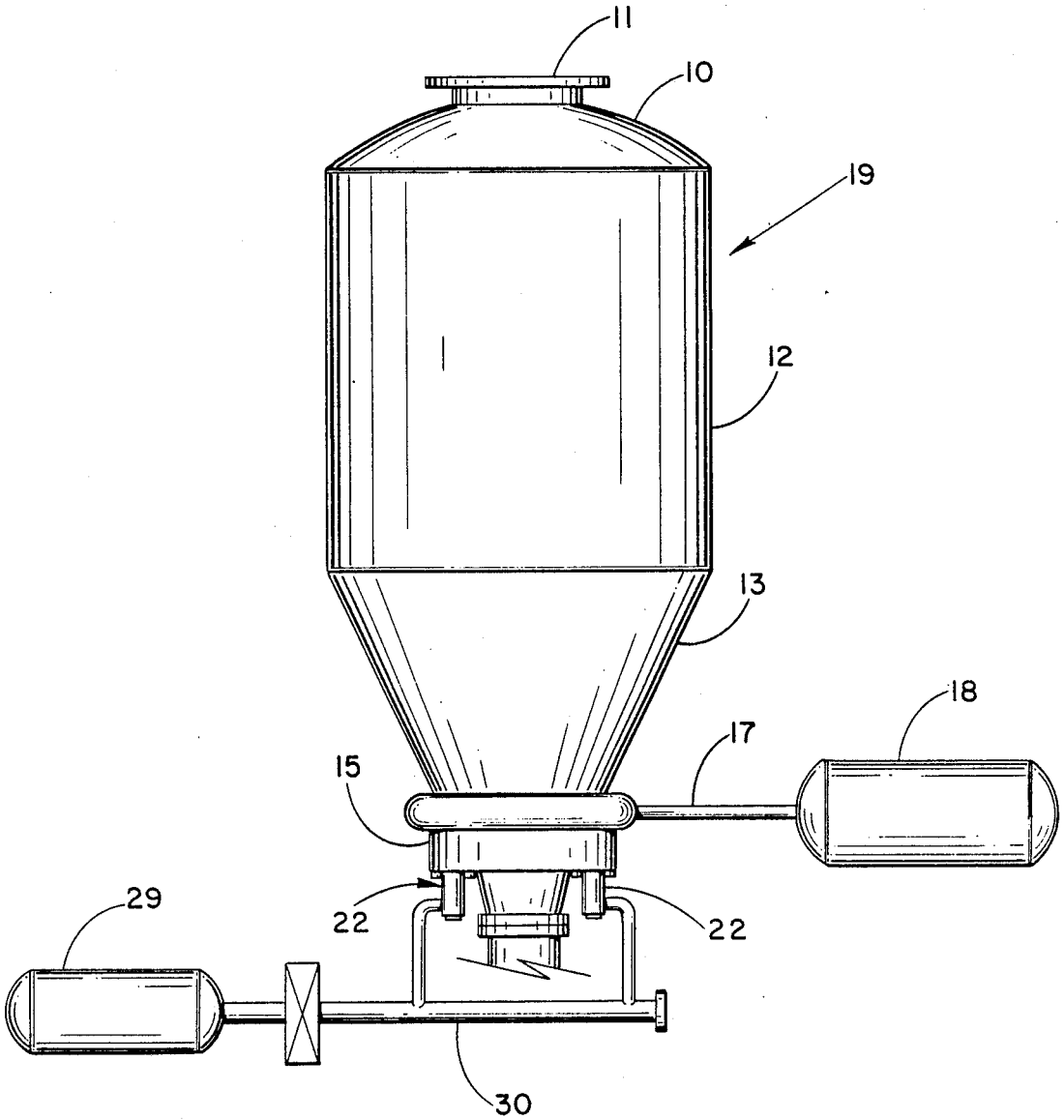
FIG. 1 is a general elevational view of a blending system incorporating the teachings of this invention.
Figure 2:
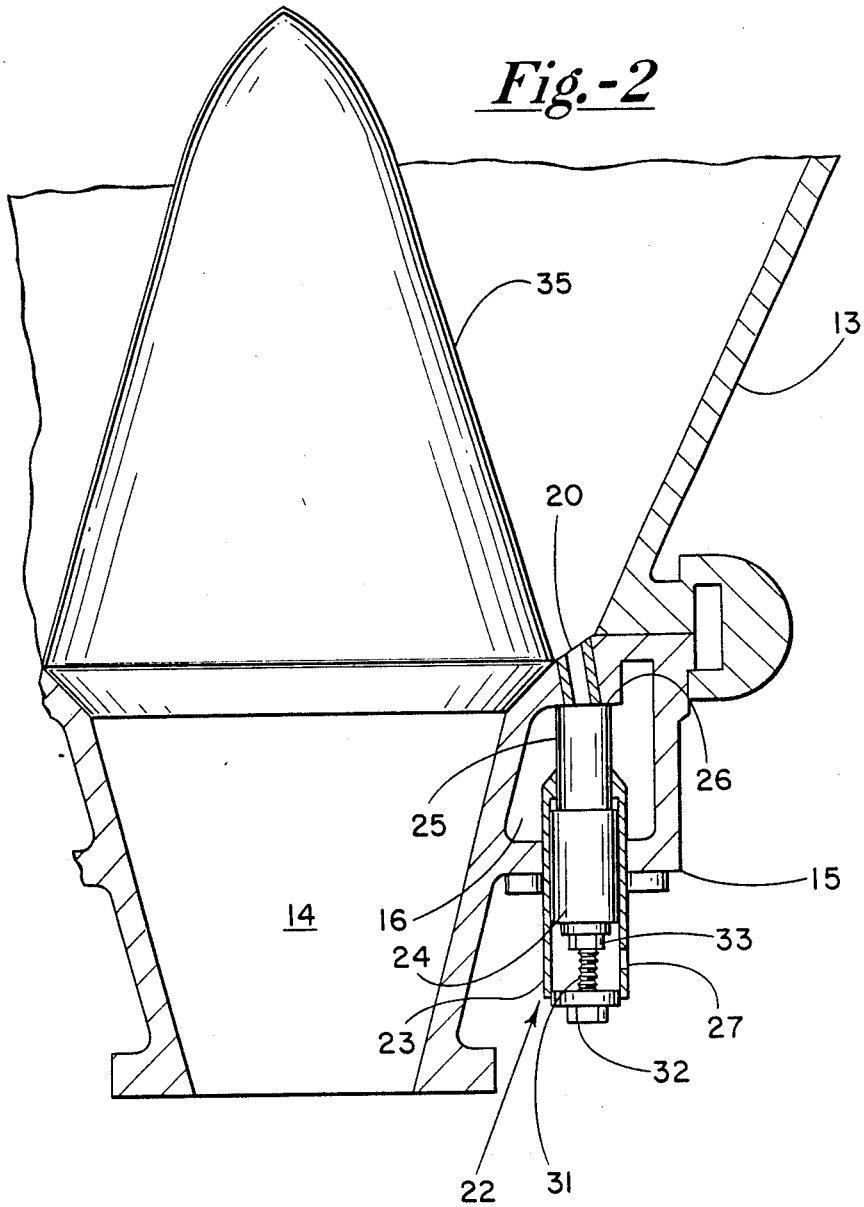
FIG. 2 is a partial sectioned, somewhat exploded, detailed view of apparatus for injecting mixing air into the blender.

A conventional generally cylindrical vessel, bin or hopper 19 (hereinafter referred to as hopper) used for pneumatically blending together various granular materials is closed off at the top 10, except for an inlet opening 11 through which dry granular materials are injected into the hopper, has vertically disposed sidewalls 12 which attach to lower, inwardly sloping sidewalls 13. Sidewalls 13 slope toward a centrally located discharge opening 14 which is surrounded by an annular pressurized-air manifold 15. Conventionally, manifold 15 has an interior chamber 16 containing pressurized air provided by a suitable hosing or pipeline 17 from a suitable air pressure source 18. The manifold has a number of circumferentially spaced openings 20, preferably equally spaced, around discharge opening 14 for providing air communication between the pressurized air in chamber 16 upward into the interior of hopper 19. Preferably, the manifold openings 20 are at a small angle directed inward to the vertical center line of the hopper. Typically, with no limitation intended, this angle may be in the order of about five degrees.

As described in the '891 patent, mounted within manifold 15 opposite each of the openings 20 is an air operated poppet valve assembly generally designated by reference numeral 22. Poppet valve assembly 22 comprises a cylinder housing 23 containing a slidably mounted piston member 24 having a stem 25 which extends out beyond the end of cylinder housing 23 and has a seal 26 at its stem end facing opening 20. An air inlet 27 through housing 23 permits pressurized air from a suitable air supply 29 to enter into the cylinder chamber via a suitable pipeline, hose or conduit 30 (FIG. 1). Cylinder housing 23 and piston 24 are suitably sealed to make the interior of cylinder housing 23 air tight. A threaded member 31 extends through housing 23 at the end of poppet valve assembly 22 opposite the stem end and has an external slot 32 at one end in which a screwdriver or the like can be inserted to thread member 31 into or out of housing 23. Member 31 has a stop 33 at its other end. The setting of stop 33 sets the amount of travel of piston member 24. The threaded member 31 can be threadably adjusted to increase or decrease the length of travel of piston member 24.

Located in the interior of the hopper over the discharge opening 14 and centrally coinciding therewith is a conical shaped diverter or deflector member 35 covering over the area of the discharge opening but not closing off the flow of material from the interior of the hopper to the discharge opening 14. Deflector 35 may be held in place by an elongated rod extending upward through the discharge opening or by thin arms attached to the interior of the hopper, neither of which is shown. The function and purpose of deflector 35 is to prevent any of the granular material which is fed into the top of the hopper from flowing directly from the inlet opening 11 in a direct or straight line fashion down through the outlet opening 14. As mentioned earlier, many granular materials have a tendency to follow a straight line path so without some means for preventing this from occurring a significant amount of the material may not get properly blended or mixed. Diverter 35 deflects any of the granular material which otherwise might tend to flow directly from the inlet to the outlet opening so that it is directed into the air stream area where it will be subject to the turbulence created by the air bursts and thereby be mixed together with the other materials.

Figure 3:
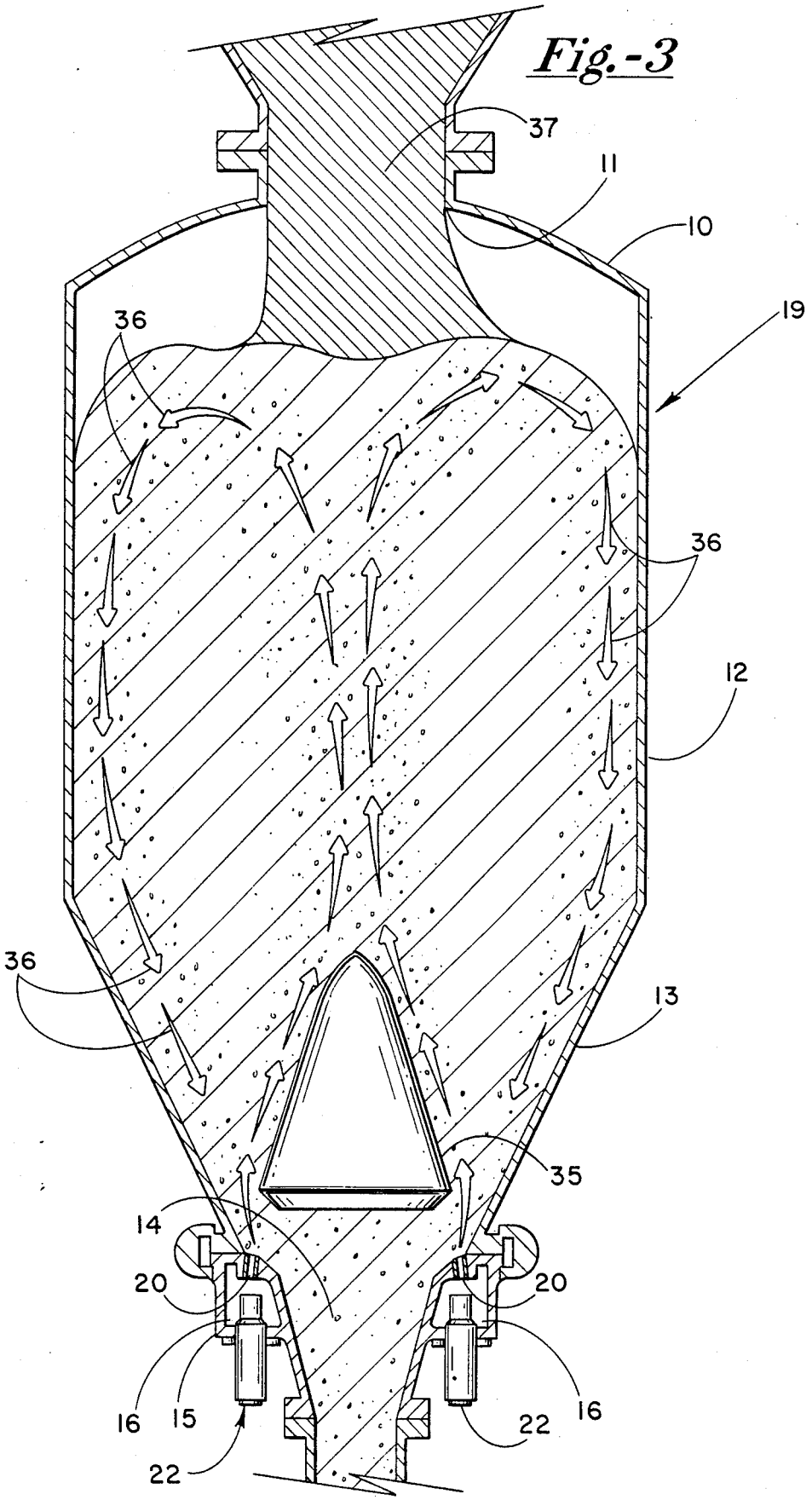
FIG. 3 diagrammatically illustrates the operation of the invention.

As illustrated in FIG. 3, dry granular materials, identified by cross-hatch lines 36, which are generally pneumatically transported via a suitable conduit or pipe are fed into inlet opening 11 at the top of hopper 19. As the materials enter the hopper they are greeted by periodic blasts or bursts of pressurized air entering the bottom of the hopper 19 from manifold 15 via openings 20 which are opened and closed by poppet valves 22. Arrows 36 generally indicate the direction of air flow from the openings which are angled slightly inward to the vertical center line of the hopper, e.g., about five degrees. In general the repeated short bursts or blasts of pressurized air create turbulence within the confines of the hopper 19 to scatter and swirl the granular materials around so that they become suitably blended or mixed together. Deflector or diverter 35 prevents any of the materials from falling directly downward from the input opening 11 to the discharge opening 14. As the materials fall downward toward the discharge opening 14, because of the constricted area around the diverter 35 the flow of the material to the discharge opening is slowed and the repetitive bursts of pressurized air from the manifold 15 drive some of the granular materials back upward in the hopper to mix with the materials that are being fed through the inlet opening 11 so that when the materials reach the outlet or discharge opening 14 they are quite thoroughly blended and mixed together in the proper ratios. The inwardly directed streams of air from openings 20 directed towards the heavier concentration of the incoming materials at the center of the hopper act on the materials to disperse them fairly uniformly throughout the interior of the hopper to thereby insure that there is a total and complete mixing and blending so that the materials which exit through the discharge opening 14 are properly blended together.

The continuous flow blending system permits the materials to be inserted into the blender, get mixed together and exit from the blender in a continuous fashion so that the flow of the material is not interrupted. This is compared to the blender as described in the '891 patent in which the materials are first put into the hopper with the discharge opening closed, then mixed together with periodic bursts of air until blending has been completed and then discharged by opening the discharge opening. As stated earlier, the combination of the deflecter or diverter 35 along with the inwardly angled air stream pulses minimizes the possibility of any of the materials flowing directly from the input 11 to the discharge opening 14 without being suitably blended.

I claim:

1. Apparatus for mixing together two or more granular materials, comprising:

(a) a vertically elongated container having an open discharge outlet at the bottom and a vertical center line;

(b) inlet means for simultaneously feeding two or more granular materials into the top of said container so they tend to fall toward the bottom of the container;

(c) means for applying pressurized gas upward and inward toward the vertical center line of the container into the falling granular materials while the granular materials are being fed into the container to cause turbulence within the container to mix the materials together; and (d) means within the container located above the discharge outlet for deflecting the granular materials from flowing in a direct path from said inlet means to said discharge outlet.

2. The invention as in claim 1 wherein said gas applying means applies the pressurized gas in repeated short bursts.

3. The invention as in claim 1 wherein said discharge outlet is generally circular and located at about the center of the bottom of the container and said deflecting means is a conically shaped member coaxial with the discharge outlet with the apex directed upwards.

4. A method for pneumatically mixing together two or more granular materials comprising the steps of:

(a) feeding at the same time two or more granular materials into the top of a container having a vertical center line;

(b) applying streams of pressurized gas upward and inward toward the vertical center line of the container into the materials while they are falling into the container to create turbulence to mix the materials together;

(c) continuously discharging the mixed granular materials through an opening in the bottom of the container; and (d) deflecting the granular materials as they fall from the top of the container toward the container bottom discharge opening for preventing the granular materials from falling in a straight path from the entry at the top of the container to the discharge opening.

5. The method as in claim 4 wherein the pressurized gas is applied in repeated short bursts.

* * * * *